US009157256B2

(12) United States Patent
Hiscocks et al.

(10) Patent No.: US 9,157,256 B2
(45) Date of Patent: Oct. 13, 2015

(54) LOCK SYSTEM

(71) Applicant: CAMWARE HOLDINGS PTY LTD, Braeside, Victoria (AU)

(72) Inventors: Brian Hiscocks, Unanderra (AU); Changyu You, Unanderra (AU)

(73) Assignee: CAMWARE HOLDINGS PTY LTD, Braeside, Victoria (AU)

( * ) Notice: Subject to any disclaimer, the term of this patent is extended or adjusted under 35 U.S.C. 154(b) by 0 days.

(21) Appl. No.: 14/524,707

(22) Filed: Oct. 27, 2014

(65) Prior Publication Data

US 2015/0114059 A1 Apr. 30, 2015

(30) Foreign Application Priority Data

Oct. 28, 2013 (AU) ..... 2013248267
Jun. 12, 2014 (AU) ..... 2014203184

(51) Int. Cl.

| | |
|---|---|
| ***E05B 27/06*** | (2006.01) |
| ***E05B 19/08*** | (2006.01) |
| ***E05B 27/00*** | (2006.01) |
| ***E05B 19/00*** | (2006.01) |
| ***E05B 35/14*** | (2006.01) |

(52) U.S. Cl.

CPC ..... *E05B 27/0003* (2013.01); *E05B 19/00* (2013.01); *E05B 19/007* (2013.01); *E05B 27/0042* (2013.01); *E05B 27/0057* (2013.01); *E05B 27/0082* (2013.01); *E05B 35/14* (2013.01); *Y10T 70/7593* (2015.04); *Y10T 70/7616* (2015.04); *Y10T 70/7621* (2015.04); *Y10T 70/7836* (2015.04); *Y10T 70/7881* (2015.04)

(58) Field of Classification Search

CPC ..... E05B 27/0003; E05B 19/007; E05B 27/0082; E05B 27/0042; E05B 35/14; E05B 27/0057; E05B 19/00; E05B 27/02; E05B 35/00; E05B 27/0039; Y10T 70/7593; Y10T 70/761; Y10T 70/7621; Y10T 70/7876; Y10T 70/7881

USPC ..... 70/337–343, 395, 400, 401, 408, 410, 70/411, 409, 491, 493–496

See application file for complete search history.

(56) References Cited

U.S. PATENT DOCUMENTS

| | | | | | |
|---|---|---|---|---|---|
| 1,899,739 | A | * | 2/1933 | Von Mehren | 70/411 |
| 2,423,734 | A | * | 7/1947 | Sterner | 70/411 |
| 2,690,070 | A | * | 9/1954 | Spain | 70/421 |
| 3,486,353 | A | * | 12/1969 | Aksel | 70/496 |
| 4,446,709 | A | * | 5/1984 | Steinbach | 70/496 |
| 4,478,061 | A | | 10/1984 | Preddey | |
| 5,791,181 | A | * | 8/1998 | Sperber et al. | 70/383 |
| 6,076,386 | A | | 6/2000 | Etchells et al. | |

(Continued)

FOREIGN PATENT DOCUMENTS

| | | |
|---|---|---|
| AU | 2013204413 | 10/2014 |
| WO | 2008112228 | 9/2008 |

*Primary Examiner* — Lloyd Gall
(74) *Attorney, Agent, or Firm* — Shutts & Bowen LLP

(57) ABSTRACT

A lock system, lock and key is provided. The lock includes additional cutouts on the face plate (123), requiring the insertion of a corresponding unblocking member on the keyblade (144). The unblocking portion engages an engagement portion (162) to allow release of a corresponding sidebar (126), thereby allowing rotation of the lock. The engagement portion (162) additionally must project to the correct length to allow the engagement portion (162) to travel the correct distance to release the sidebar (126).

15 Claims, 6 Drawing Sheets

(56) References Cited

U.S. PATENT DOCUMENTS 6,477,875 B2 * 11/2002 Field et al. ..... 70/491
6,681,609 B1 * 1/2004 Preddey ..... 70/495
7,797,973 B2 * 9/2010 Field et al. ..... 70/337
8,186,194 B2 * 5/2012 Field et al. ..... 70/491
2003/0024287 A1 2/2003 Field et al.

* cited by examiner

LOCK SYSTEM

TECHNICAL FIELD

The present invention relates to locks, keys and lock systems.

BACKGROUND OF THE INVENTION

Locksmiths typically use several relevant terms interchangeably when referring to particular features associated with locks. To avoid confusion the following terms will be assumed to be used in the following sense throughout the description and claims.

In a lock of the pin tumbler or similar type, the lock comprises a central core or plug and an outer housing or shell, in which the core rotates, the housing being mounted in a suitable latch structure. The terms core and housing will be used in this context. Similarly, it will be appreciated that the present invention may be applied to any type of latch structure for which pin tumbler and related locks are used, for example, cam locks, door locks, phone locks and security fittings.

Although such locks afford a high degree of security, it would be desirable if the resistance of the lock to unauthorised unlocking was increased even further.

In International PCT No. PCT/AU99/00722 by Australian Lock Company Pty Ltd, a locking system is described which was an improvement on their BILOCK™ locking system. The improved system added additional locking elements to the conventional BILOCK™ lock which was engaged by an additional moveable element on the modified BILOCK™ key. The disclosure of this application is hereby incorporated by reference into the present application.

In Australian Patent Application No. 2013204413 by Camware Holdings Pty Ltd, an improved locking system was proposed utilising sliding sidebar blocking members engaged by separate components on the key.

It is an object of the present invention to provide an alternative locking system.

SUMMARY OF THE INVENTION

According to the present invention there is provide a lock system including:

a lock, including:

a lock housing having a cylindrical cavity for receiving a rotatable lock core, said housing having upon its internal surface a longitudinal slot;

a substantially cylindrical lock core arranged within said cavity; said lock core having a keyway formed therein and extending longitudinally from an end face of said lock core; said lock core further including a plurality of guide bores which extend outwardly from said keyway and communicate therewith; each guide bore receiving a respective locking pin; wherein coding on a key blade operatively inserted into said keyway causes each locking pin to move along the respective guide bore; said lock core further including a recess extending outwardly from said plurality of guide bores and communicating therewith; said recess receiving a sidebar; said lock core further including a channel, said channel including an opening which communicates with said recess, and a sidebar blocking member slideably received in said channel;

a face plate arranged to be positioned at the end face of said lock core, the face plate including a keyway cutout which aligns with said keyway, said face plate further including an additional cutout portion, wherein said additional cutout portion is located adjacent the keyway cutout and is selectably positioned at one of a plurality of heights relative to the height of the keyway cutout;

each locking pin further comprising a hole, the position of the hole along the locking pin defining a locking combination for the respective locking pin;

said sidebar further comprising protrusions which are directed inwardly towards said guide bores, said sidebar being biased outwardly away from said side bores and into said longitudinal slot; said sidebar further comprising a blockable portion which is arranged to protrude through said opening;

said sidebar blocking member further comprising a notch; wherein said sidebar blocking member is biased towards a position in which said notch is not aligned with said opening, in which position said sidebar blocking member presents a barrier to said blockable portion and prevents said sidebar from moving inwardly towards said guide bores; said sidebar blocking member further includes an engagement portion which extends from an end of said sidebar blocking member and is formed at one of a plurality of selectable heights with respect to the end of said sidebar blocking member, each of said plurality of selectable heights of said engagement portion corresponding to a respective one of said plurality of heights of said additional cutout portion on said face plate, wherein the engagement portion is exposed to contact via said additional cutout portion when the selected heights of said engagement portion and said additional cutout portion correspond;

said system further including:

a key including a key handle and a key blade extending therefrom; said key blade having coded bitings, wherein upon insertion of said key blade into said keyway, correctly coded bitings move the locking pins along the guide bores until the holes are aligned with said recess; said key further including an unblocking member, which unblocking member operatively protrudes from said key handle substantially parallel to and adjacent a side of said key blade, wherein said unblocking member is selectively positioned at one of a plurality of heights relative to the height of said key blade, each of said plurality of heights corresponding respectively to one of said plurality of heights of said additional cutout portion on said face plate;

wherein operatively, during key blade insertion into said key way, said unblocking member, being positioned at a selected height corresponding with the selected height of the additional cutout portion, engages said exposed engagement portion and moves said sidebar blocking member to an unblocking position in which said notch is aligned with said opening, in which unblocking position said sidebar blocking member presents no barrier to said blockable portion; wherein turning the inserted key causes the lock core to attempt to rotate, causing the unblocked sidebar to move inwardly against its bias and the inwardly directed protrusions enter the aligned holes, whereby the unblocked sidebar is capable of moving out of the longitudinal slot, thereby allowing the lock core to rotate.

In exemplary embodiments, the position of the notch on the sidebar blocking member can be selected from a number of possible positions, the selected position dictating the required length which the corresponding unblocking member is required to operatively protrude from the key handle in order to align the selected notch position with the opening. This advantageously extends the coding possibilities of the lock system and provides powerful masterkeying options for the system.

According to further aspects of the present invention there are provided a lock, a key and a key handle, each having features which are adapted to be employed in the lock system.

BRIEF DESCRIPTION OF THE DRAWINGS

Embodiments of the present invention will now be described with reference to the accompanying drawings, in which.

DETAILED DESCRIPTION OF THE INVENTION

The present invention will be discussed in the context of the BILOCK™ devices manufactured and sold by Australian Lock Company, a description of which can be found in U.S. Pat. No. 4,478,061, the disclosure of which is herein incorporated by way of reference. It is emphasised, however, that in addition the present invention is readily applicable to single bladed key systems or any lock arrangement using a central core containing the complete set of lock coding elements, with suitable modifications to the recesses and sidebar arrangement as will be discussed below.

The present implementation, which will be described below, has been conceived as a direct improvement of the lock system disclosed in Australian Patent Application No. 2013248267, the disclosure of which is herein incorporated by reference. However, it will be apparent that the present invention may be applied to locks with different mechanisms, and the present invention is not limited to BILOCK type devices. The disclosures of the priority applications, Australian Application No 2014203184 and 2013248267, are hereby incorporated by reference.

Figure 1:
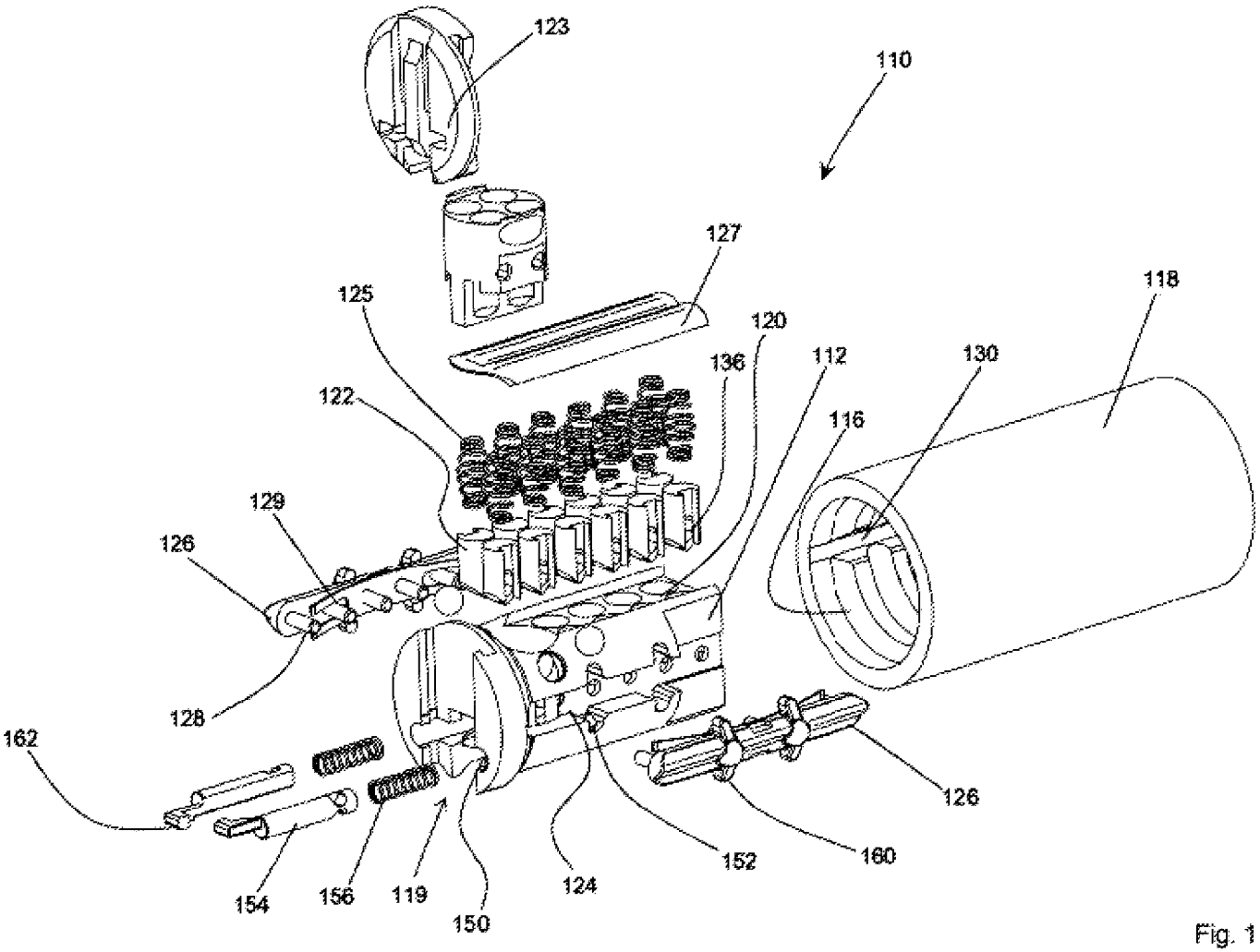
FIG. 1 is an exploded view of a lock system according to a preferred embodiment.
Figure 2:
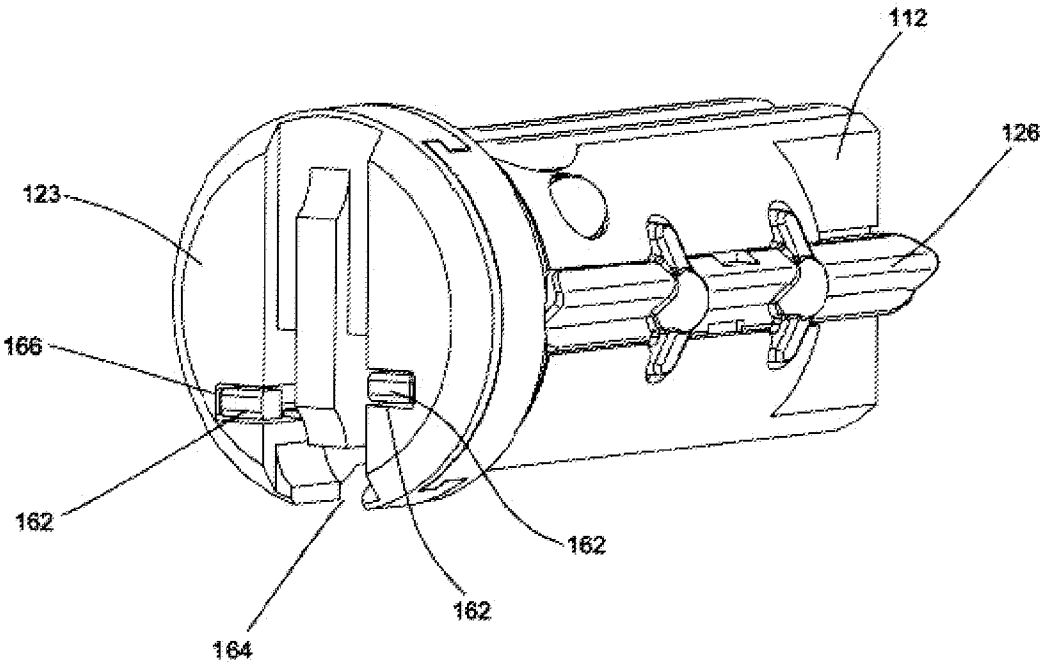
FIG. 2 is a view of the lock core of the system of FIG. 1.

Referring to FIGS. 1 and 2, a lock 110 has a core 112 received in a longitudinal cavity 116 of a housing 118. As is well known, the core 112 has a keyway 119 and a plurality of guide bores 120 aligned with the keyway 119 and receptive locking pins 122. A face plate 123 is located at the end face of the core 112. The locking pins 122 are inwardly biased in the guide bores 120 by springs 125 and a cover plate 127 as per the original BILOCK™ design. On either side, the core 112 features a longitudinally disposed sidebar recess 124 for the accommodation of sidebars 126. The sidebar recess 124 is in communication with the guide bores 120. The sidebars 126 feature a series of inwardly extending protrusions 128 in the shape of pins and are biased away from the guide bores 120 by sidebar springs 129 or other biasing means as known in the art. At the end of the core 112 opposite the key entry of the keyway 119 the body of the core 112 is flattened on either side to provide a suitable means for interacting with a latch mechanism (not shown).

As per the original BILOCK™ design, on the inner surface of the housing are two longitudinal slots 130. The longitudinal slots 130 are shaped to receive the sidebars 126, which are biased theretowards.

Each locking pin 122 is provided with a hole 136. The holes 136 correspond to locking combinations for the lock dictated by the relative position of the hole 136 along the height of the locking pin 122.

The combination of a key 140 is provided by bittings 142 cut on the key blade 144. When the key blade 144 is inserted into the keyway 119, the bittings 142 move the locking pins 122 a corresponding height along the respective guide bores 120. In accordance with the normal operation of BILOCK™, a correctly coded key moves the locking pins 122 so that the respective holes 136 are aligned with the sidebar recess 124 and are capable of receiving the inwardly extending protrusions 128 of the sidebars 126 when the sidebars 126 are caused to move against their bias inwardly.

As will be appreciated, an incorrectly coded key blade would not align the holes 136, which would prevent the sidebar 126 moving inwardly and retain the sidebar 126 in the longitudinal slot 130, hence preventing rotation of the lock core 112.

In contrast to the original BILOCK™ design, the core 112 includes a channel 150 which extends longitudinally alongside the keyway 119 and adjacent the recess 124. The channel 150 has an opening 152 between the channel 150 and the adjacent recess 124. Within the channel 150 is slideably arranged a sidebar blocking member 154 which is biased towards the end face of the core 112 by springs 156 or other biasing means as known in the art.

Figure 3:
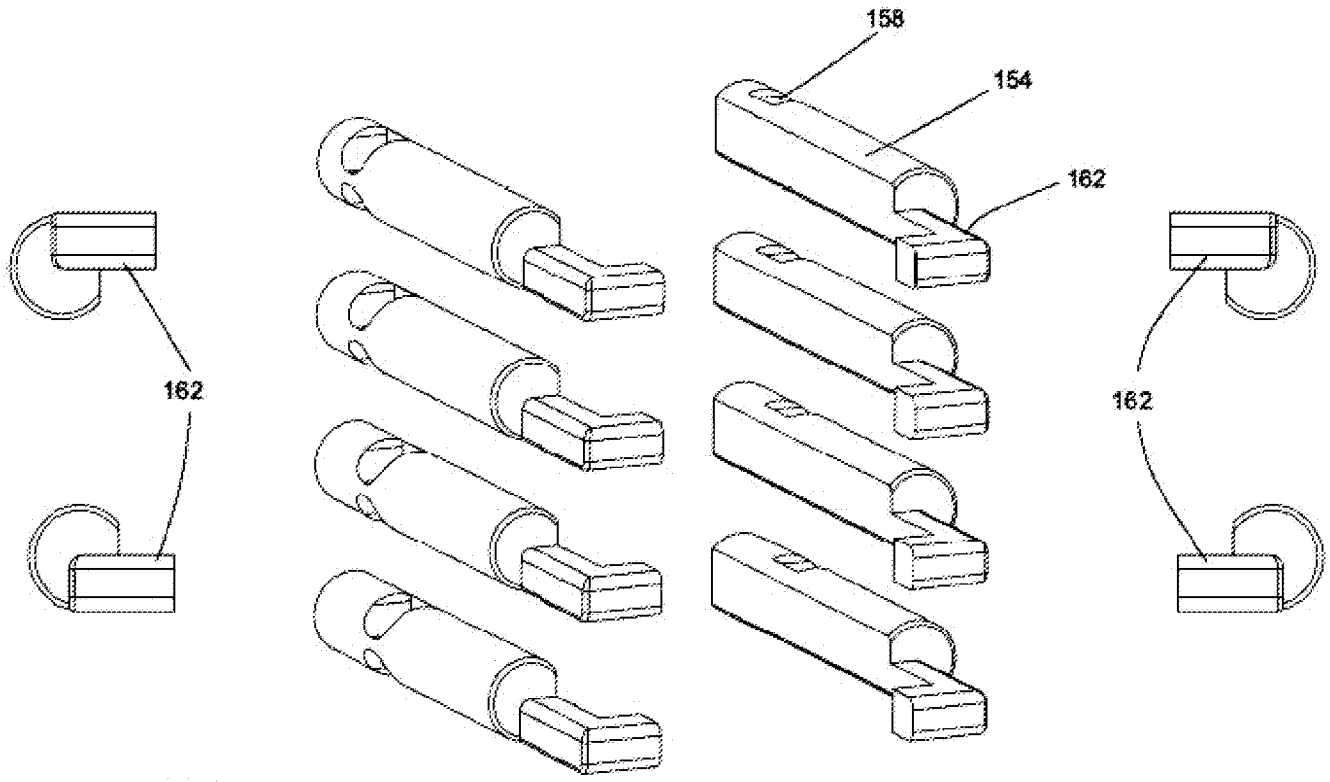
FIG. 3 shows different notch positions on a sidebar blocking member and different configurations for an engagement portion.

As shown in FIG. 3, the sidebar blocking member 154 has a notch 158 which can be arranged on one of a number of positions along the member 154.

The sidebar 126 includes additional protrusions 160 on its upper and lower surface which are arranged and shaped to protrude through the opening 152 with the adjacent channel 150. These additional protrusions 160 therefore extend into the adjacent channel 150 and are able to interact with the sidebar blocking member 154 as blockable portions of the sidebar 126.

Figure 4:
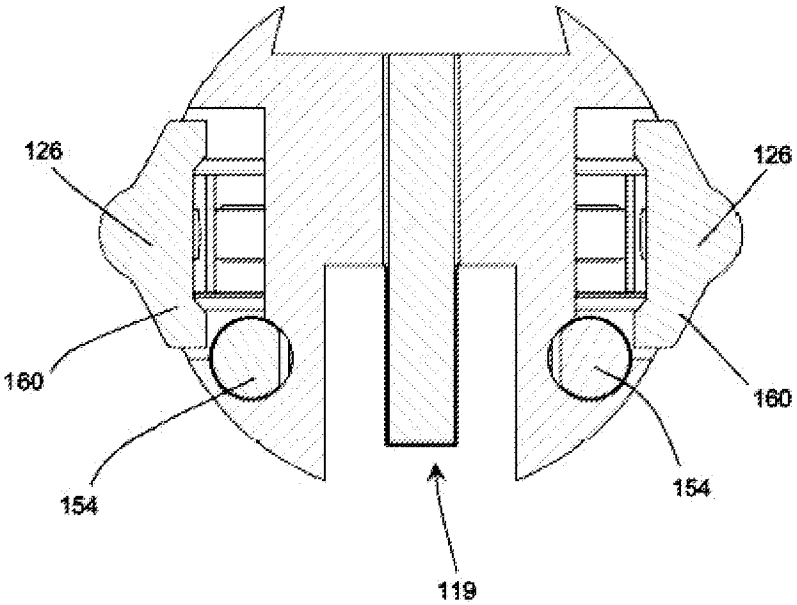
FIG. 4 is a cross-sectional view of the lock system of FIG. 1 having the sidebars blocked.

When the sidebar blocking member 154 is positioned so that its notch 158 is not aligned with the opening 152, the sidebar blocking member 154 acts as a barrier which prevents the sidebar 126 from moving inwardly due to the fact that the blockable portions 160 of the sidebar 126 would find their inward passage blocked by the sidebar blocking member 154, see FIG. 4.

Figure 5:
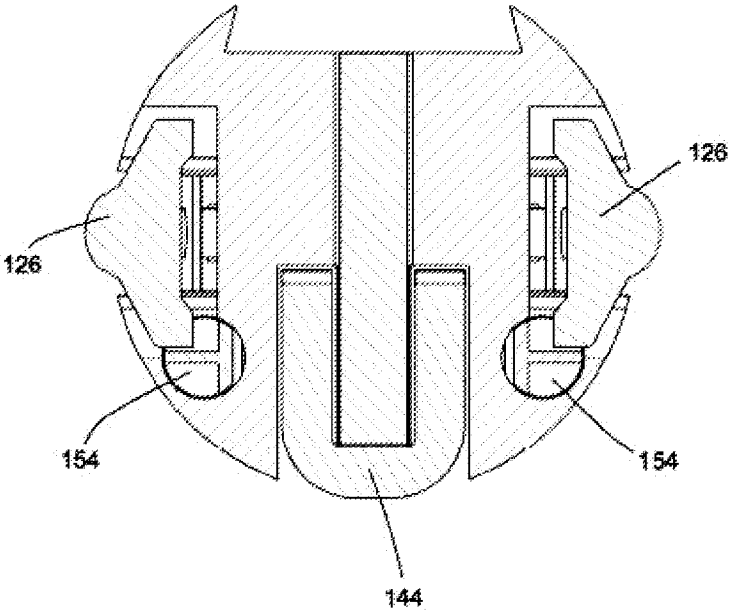
FIG. 5 is a cross-sectional view of the lock system of FIG. 4 having the sidebars unblocked.

However, when the sidebar blocking member 154 is positioned so that its notch 158 is aligned with the opening 152, the notch 158 is shaped and sized so as to present an inward passage for the blockable portions 160 of the sidebar 126 and therefore allow inward movement of the sidebar 126, see FIG. 5.

As will be appreciated, the sidebar blocking member 154 and the modification to the sidebar act as an additional locking element to the lock. While a correctly coded BILOCK™ key would, when the blade is inserted into the keyway 119, properly align the holes 136 of the locking pins 122, the sidebar 126 would be prevented from being able to engage the holes 136 of the locking pins 122 due to the notch 158 of the sidebar blocking member 154 being unaligned with the opening 152.

The sidebar blocking member is formed with an engageable portion 162 at one end. The engagement portion 162 is selectably formed in one of a number of positions. In the embodiment shown in FIG. 3, there are two possible positions, an upper position and a lower position, on each side of the keyway 119.

The face plate 123 includes a keyway cut out 164 which, when the face plate is in position at the end face of the core, aligns with the keyway 119. In addition to the keyway cutout 164 are additional cutout portions 166. As shown, each additional cutout 166 can be selectively positioned at different heights with respect to the keyway cutout 164. The different heights correspond with the different positions of the engageable portion 162 on the sidebar blocking member 154. As will be appreciated, properly selecting the engagement portion position to correspond to the height of the additional cutout exposes the engagement portion 162 via the additional cutout 166.

In order to facilitate correct operation of the lock, not only do the holes 136 of the locking pins 122 need to be aligned by correct coding on a corresponding key 140, but the sidebar blocking member 154 needs to be moved so that the notch 158 is aligned with the opening 152. Movement of the sidebar blocking member 154 is achieved by modification to the original BILOCK™ key.

Figure 6:
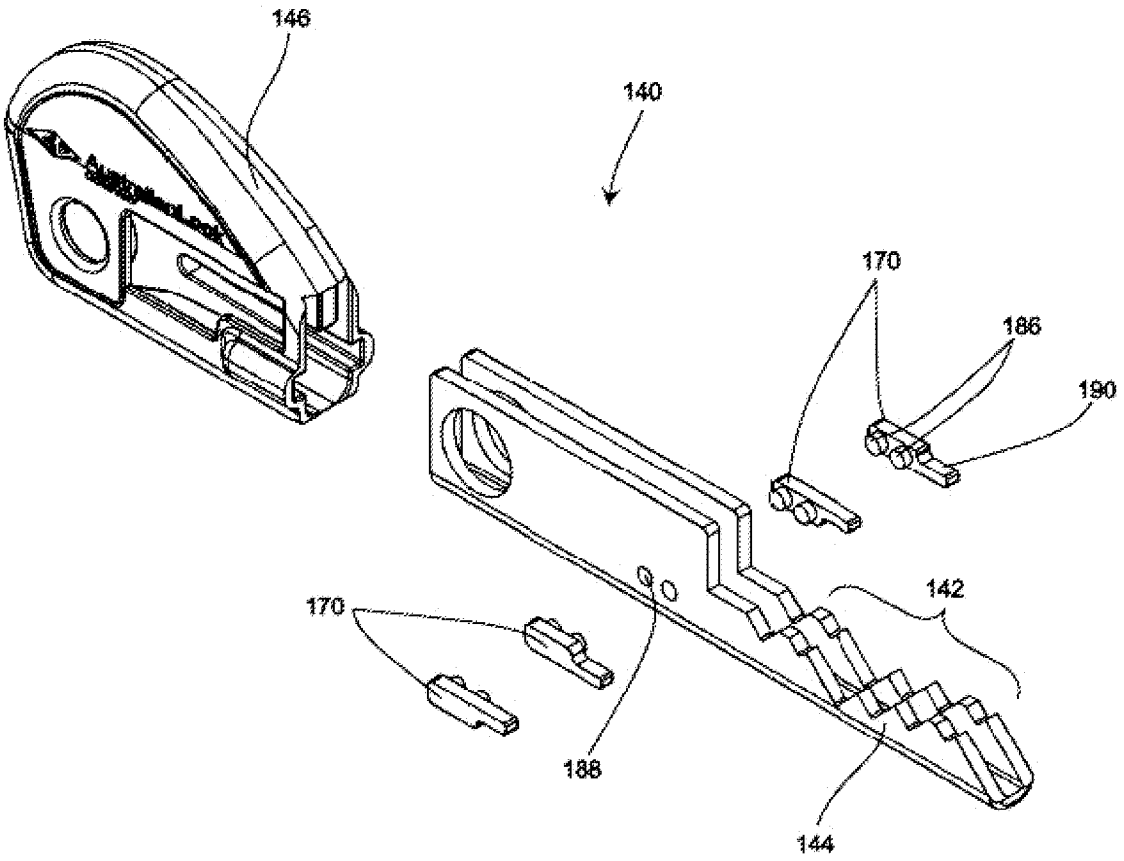
FIG. 6 is an exploded view of one embodiment of a key.

As shown in FIG. 6, the key 140 is formed of a key handle 146 and an attachable key blade 144. The key 140 includes unblocking members 170 which operatively protrude from the key handle 146 alongside the attached key blade 144.

The unblocking member 170 includes protrusions 186 which engage holes 188 formed on the key blade 144 and are retained within the key handle 146 when the key handle 146 is attached. Aside from attaching the unblocking member 170 to the key blade 144, this arrangement also properly aligns the unblocking member 170 with the key blade 144. The unblocking member 170 is formed with an elongated portion 190 which extends alongside the key blade 144. As shown, the elongated portion 190 can be selectively formed at an upper or lower position. These different positions correlate to different heights, relative to the height of the key blade 144, in which the elongated portion 190 can be arranged.

In operation, it is the elongated portion 190 which enters the additional cutout 166, during key blade insertion into the key way 119, and engages the engageable portion 162 of the sidebar blocking member 154. As will be appreciated, for correct operation, the selected height position of the elongated portion 190 of the unblocking member 170 needs to correlate with the selected height of the cutout portion 166 and the corresponding position of the engagement portion 162 of the sidebar blocking member 154 in order for engagement to occur. If the positions of the elongated portion 190 and the additional cutout 166 do not correlate, then engagement will not occur during key blade insertion and, hence, the sidebar 126 will remain blocked. As a consequence, the selectable positions of both the elongated portion 190 and the additional cutout 166 offer extra coding for the lock system.

In addition, the length of the elongated portion 190 is important for correct operation. The length of the elongated portion 190 dictates the amount that the sidebar blocking member 154 is moved in its channel 150, assuming that the selected positions of the elongated portion 190 and the additional cutout 166 correlate. For correct operation, the selected length of the elongated portion 190 needs to correlate with the selected notch position on the sidebar blocking member 154 so that the sidebar blocking member 154 is moved to the position in which the notch 158 is aligned with the opening 152. As a consequence, the selectable length of the elongated portion 190 and the selectable notch position on the sidebar blocking member 154 adds further coding options for the lock system.

In effect, a correct key is required to have a number of correct factors in order to function. Firstly, it must have correctly coded bitings 142 corresponding to the lock combination provided by the locking pins 122. Secondly, the elongated portion 190 position must correlate with the selected height of the additional cutout 166 as well as the corresponding position of the engageable portion 162 of the sidebar blocking member 154 in order for the elongated portion 190 to engage and, therefore, move the sidebar blocking member 154. Lastly, the length of the elongated portion 190 must correlate with the notch position on the sidebar blocking member 154 in order for the notch 158 to be moved to the unblocking position, in which it is aligned with the opening 152. In other words, the depth of penetration by the elongated portion dictates how far the sidebar blocking member 154 is moved.

In the embodiment illustrated, for each side of the key, there are effectively eight interchangeable variations on the unblocking member 170 in order to provide for the two different heights of the elongated portion 190, as well as the four different lengths of the elongated portion 190 (to correspond to the four different notch positions shown in FIG. 3). In an alternative embodiment, instead of having different variations on the unblocking member 170, the requirements for providing different heights and depth of penetration of the elongated portion 190 could be facilitated by varying the position of the holes 188 on the key blade 144 to achieve the same result. In this way a uniform version of the unblocking member 170 could be utilised. The different height of its elongated portion could be dictated by forming the holes 188 at different heights on the key blade. Similarly, the different penetration depths, in order to move the notch 158 the required distance, could be dictated by forming the holes at different positions along the length of the key.

Figure 7:
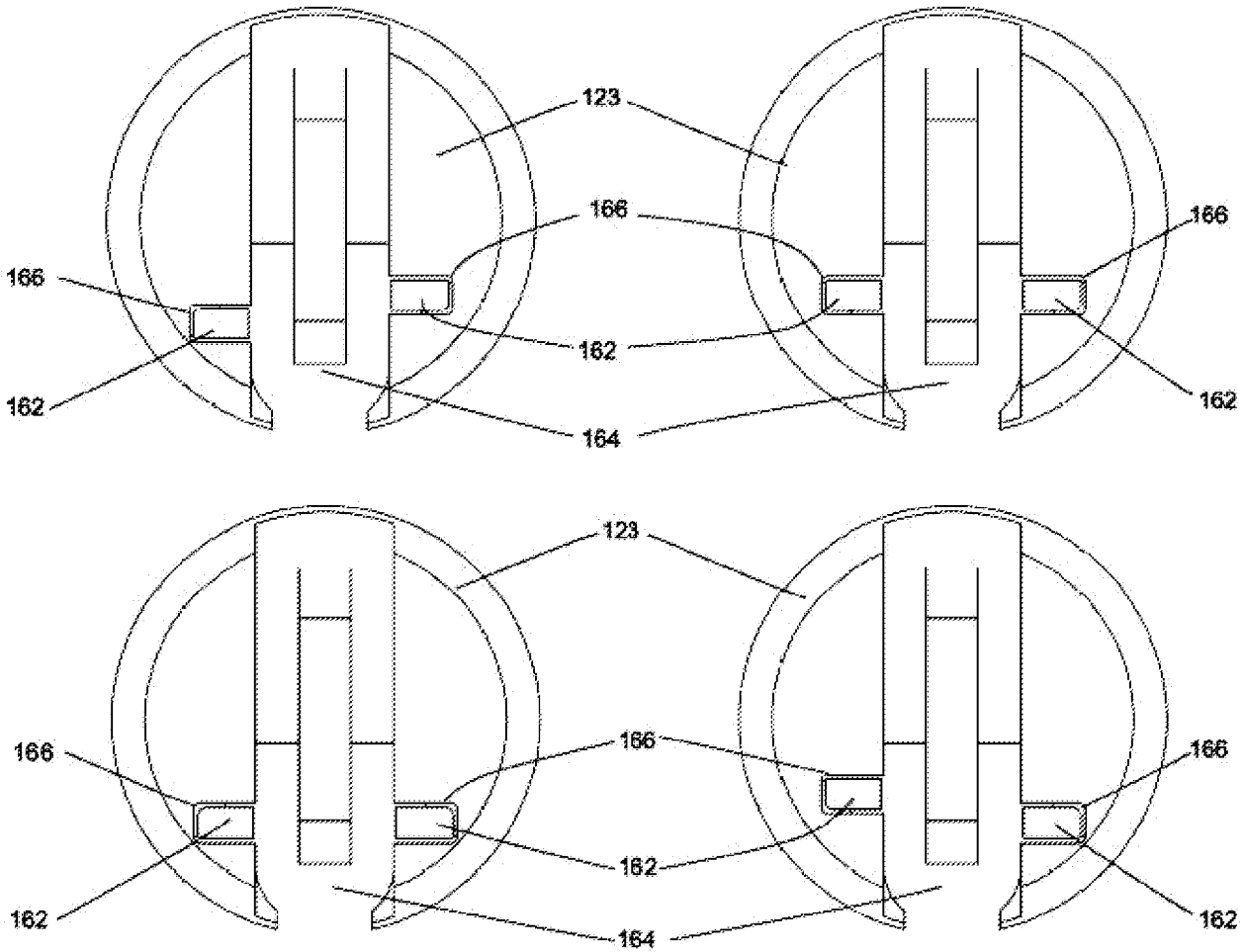
FIG. 7 shows different configurations of possible cutout positions on a face plate.

In the embodiment illustrated, there is shown a BILOCK™ type of lock with two sidebars 126. Each sidebar 126 having only one respective sidebar blocking member 154 in a respective channel 150. In this embodiment, the key only requires a corresponding number of unblocking members 170, that being two. However, as shown in FIG. 7, this offers four variations on the positions of the additional cutouts 166.

It will be appreciated that while the embodiment shown in FIG. 3 show only two optional positions for the engageable portion 162, it may be possible to provide more than two options using precision engineering. In such a case, there would need to be a corresponding number of selectable heights for the associated elongated portion 190 of the unblocking member as well as a corresponding number of heights for the additional cutout 166. As a consequence, more than just the four variations shown in FIG. 7 could be derived.

It will be appreciated that in a single bladed key embodiment only a single set of locking pins 122 would be required and, hence, use of only a single sidebar 126. Consequently, a single sidebar arrangement may only require one respective sidebar blocking member 154 and associated channel 150; whereby the key would only require a single corresponding unblocking member 170.

Conceivably, a variation on the embodiment illustrated could be the use of more than one sidebar blocking member for each sidebar. In which case, an additional channel would be required for the additional sidebar blocking member. Furthermore, an additional access would be required to allow engagement of the additional sidebar blocking member as well as an additional unblocking member appropriately positioned on the key for engaging the additional sidebar blocking member.

In the assembled key of the illustrated embodiment, the elongated portion 190 of the unblocking member 170 is a fixed protrusion extending from the key handle. Conceivably, it would be possible to modify the design in order to allow the protrusions to be retractable within the key handle, such modifications have been proposed in Australian Patent Application No. 2013204413, the disclosure of which is hereby incorporated by reference.

Reference should be made to the various references incorporated herein in order to clarify any details of operation or construction, as the basic operation of the lock and key according to the implementation described as described in those references in more detail.

It will be appreciated that variations and additions are possible within the general scope of the present invention. The embodiments described should be taken as illustrative of the implementation of the present invention, and not limitative thereof.

The invention claimed is:

1. A lock system comprising: a lock, comprising:

a lock housing having a cylindrical cavity for receiving a rotatable lock core, said housing having upon its internal surface a longitudinal slot;

a substantially cylindrical lock core arranged within said cavity; said lock core having a keyway formed therein and extending longitudinally from an end face of said lock core; said lock core further including a plurality of guide bores which extend outwardly from said keyway and communicate therewith; each guide bore receiving a respective locking pin; wherein coding on a key blade operatively inserted into said keyway causes each locking pin to move along the respective guide bore; said lock core further including a recess extending outwardly from said plurality of guide bores and communicating therewith; said recess receiving a sidebar; said lock core further including a channel, said channel including an opening which communicates with said recess, and a sidebar blocking member slideably received in said channel;

a face plate arranged to be positioned at the end face of said lock core, the face plate including a keyway cutout which aligns with said keyway, said face plate further including an additional cutout portion, wherein said additional cutout portion is located adjacent the keyway cutout and is selectably positioned at one of a plurality of heights relative to the height of the keyway cutout;

each locking pin further comprising a hole, the position of the hole along the locking pin defining a locking combination for the respective locking pin;

said sidebar further comprising protrusions which are directed inwardly towards said guide bores, said sidebar being biased outwardly away from said side bores and into said longitudinal slot; said sidebar further comprising a blockable portion which is arranged to protrude through said opening; said sidebar blocking member further comprising a notch; wherein said sidebar blocking member is biased towards a position in which said notch is not aligned with said opening, in which position said sidebar blocking member presents a barrier to said blockable portion and prevents said sidebar from moving inwardly towards said guide bores; said sidebar blocking member further includes an engagement portion which extends from an end of said sidebar blocking member and is formed at one of a plurality of selectable heights with respect to the end of said sidebar blocking member, each of said plurality of selectable heights of said engagement portion corresponding to a respective one of said plurality of heights of said additional cutout portion on said face plate, wherein the engagement portion is exposed to contact via said additional cutout portion when the selected heights of said engagement portion and said additional cutout portion correspond;

said system further including:

a key including a key handle and a key blade extending therefrom; said key blade having coded bittings, wherein upon insertion of said key blade into said keyway, correctly coded bittings move the locking pins along the guide bores until the holes are aligned with said recess; said key further including an unblocking member, which unblocking member operatively protrudes from said key handle substantially parallel to and adjacent a side of said key blade, wherein said unblocking member is selectively positioned at one of a plurality of heights relative to the height of said key blade, each of said plurality of heights corresponding respectively to one of said plurality of heights of said additional cutout portion on said face plate;

wherein operatively, during key blade insertion into said keyway, said unblocking member, being positioned at a selected height corresponding with the selected height of the additional cutout portion, engages said exposed engagement portion and moves said sidebar blocking member to an unblocking position in which said notch is aligned with said opening, in which unblocking position said sidebar blocking member presents no barrier to said blockable portion; wherein turning the inserted key causes the lock core to attempt to rotate, causing the unblocked sidebar to move inwardly against its bias and the inwardly directed protrusions enter the aligned holes, whereby the unblocked sidebar is capable of moving out of the longitudinal slot, thereby allowing the lock core to rotate.

2. The lock system according to claim 1, wherein the position of the notch on the sidebar blocking member can be selected from a number of possible positions, the selected position dictating the required length which the corresponding unblocking member is required to operatively protrude from the key handle in order to align the selected notch position with the opening.

3. The lock system of claim 1, wherein said lock core includes a second recess adapted to receive a second sidebar, said second sidebar being biased outwardly into a second longitudinal slot formed on the internal surface of said lock housing.

4. The lock system of claim 3, wherein said lock core includes a second set of locking pins which operatively interact with said second sidebar.

5. The lock system of claim 4, wherein said keyway is adapted to receive a key having a second blade, wherein said second blade operatively interacts with said second set of locking pins.

6. The lock system of claim 3, wherein said lock core includes at least one further longitudinal channel with an opening communicating with said second recess and an associated sidebar blocking member which interacts with said second sidebar; wherein said key includes at least one further unblocking member to operatively interact with a corresponding further sidebar blocking member.

7. A lock, comprising:

a lock housing having a cylindrical cavity for receiving a rotatable lock core, said housing having upon its internal surface a longitudinal slot;

a substantially cylindrical lock core arranged within said cavity; said lock core having a keyway formed therein and extending longitudinally from an end face of said lock core; said lock core further including a plurality of guide bores which extend outwardly from said keyway and communicate therewith; a respective locking pin moveably received in each guide bore; said lock core further including a recess extending outwardly from said plurality of guide bores and communicating therewith; a sidebar received in said recess; said lock core further including a channel, said channel including a channel opening which communicates with said recess, and a sidebar blocking member slideably received in said channel;

a face plate arranged to be positioned at the end face of said lock core, the face plate including a keyway cutout which aligns with said keyway, said face plate further including an additional cutout portion, wherein said additional cutout portion is located adjacent the keyway cutout and is selectably positioned at one of a plurality of heights relative to the height of the keyway cutout;

said sidebar further comprising protrusions which are directed inwardly towards said guide bores, said sidebar being biased to a position outwardly away from said guide bores and into said longitudinal slot at which position the sidebar blocks rotation of the lock core;

each locking pin further comprising a hole, the position of the hole along the locking pin defining a locking combination for the respective locking pin; said sidebar being moveable against said bias to an unlock position towards the guide bores, said sidebar being blocked from the unlock position when any of the locking pin holes are misaligned relative to the recess, said sidebar being moveable to the unlock position only when the locking pin holes are aligned with the recess;

said sidebar further comprising a blockable portion which is arranged to protrude through said channel opening; said sidebar blocking member further comprising a notch; wherein said sidebar blocking member is biased towards a position in which said notch is not aligned with said channel opening, in which position said sidebar blocking member presents a barrier to said blockable portion and prevents said sidebar from moving inwardly towards said guide bores; and wherein said sidebar blocking member is slideable to an unlock position in which said notch is aligned with said channel opening, in which unlock position, said sidebar is permitted to move inwardly towards said guide bores; said sidebar blocking member further includes an engagement portion which extends from an end of said sidebar blocking member and is formed at one of a plurality of selectable heights with respect to the end of said sidebar blocking member, each of said plurality of selectable heights of said engagement portion corresponding to a respective one of said plurality of heights of said additional cutout portion on said face plate, wherein the engagement portion is exposed to contact via said additional cutout portion when the selected heights of said engagement portion and said additional cutout portion correspond;

whereby said lock is operatively adapted to receive a key blade having coded bittings corresponding to the locking combination to move the locking pins along the guide bores until the holes are aligned with said recess and said lock is operatively adapted to receive an unblocking member selectively positioned at one of a plurality of heights relative to the height of said key blade corresponding respectively to one of said plurality of heights of said additional cutout portion on said face plate so that during key blade insertion into said keyway, the unblocking member engages said exposed engagement portion and moves said sidebar blocking member to an unblocking position in which said notch is aligned with said channel opening and turning the inserted key causes the lock core to attempt to rotate, causing the unblocked sidebar to move inwardly against its bias and the inwardly directed protrusions enter the aligned holes, whereby the unblocked sidebar is capable of moving out of the longitudinal slot, thereby allowing the lock core to rotate.

8. A lock according to claim 7, wherein the position of the notch on the sidebar blocking member can be selected from a number of possible positions, the selected position dictating the required length which a corresponding unblocking member is required to extend relative to a blade length to align the selected notch position with the channel opening.

9. A lock according to claim 7, wherein said lock core includes a second recess adapted to receive a second sidebar, said second sidebar being biased outwardly into a second longitudinal slot formed on the internal surface of said lock housing.

10. A lock according to claim 9, wherein said lock core includes a second set of locking pins which operatively interact with said second sidebar, each locking pin of said second set further comprising a hole, the position of the hole along the locking pin defining a second locking combination for the respective locking pin, whereby said second set of locking pins are moveable by a second blade of a key.

11. A lock according to claim 10, wherein said keyway is adapted to receive a key having a second blade, wherein said second blade operatively interacts with said second set of locking pins.

12. A lock according to claim 9, wherein said lock core includes at least one further longitudinal channel with an opening communicating with said second recess and an associated sidebar blocking member which interacts with said second sidebar; wherein said key includes at least one further unblocking member to operatively interact with a corresponding further sidebar blocking member.

13. A key comprising a key handle and two parallel key blades extending therefrom; each said key blade having coded bittings, the bittings being operatively adapted so that when the key is inserted into a corresponding lock, correctly coded bittings move locking pins of the lock into a release position; said key further including an unblocking member on each blade, each unblocking member being operatively adapted so that when the key is inserted into a corresponding lock, each unblocking member engages and moves a blocking member of the lock, each unblocking member being attached to the outer side of the respective key blade and having a height position selected from at least two different height positions at the time of attachment, each unblocking member protruding from said key handle so that its entire unblocking portion is extending substantially parallel to and adjacent a side of its respective key blade, whereby when the key is inserted into a corresponding lock, the height position of each unblocking member corresponds to a height position of the blocking members to move the blocking members into a release position as the bittings move the lock pins into a release position.

14. A key according to claim 13, wherein each unblocking member has at least two positions in which it can be affixed, and each position corresponds to a different height position.

15. A key according to claim 14, wherein the axial position of each unblocking member is selectable at the time of attachment of the unblocking member.

* * * * *